US006994031B2

(12) United States Patent
Huang

(10) Patent No.: US 6,994,031 B2
(45) Date of Patent: Feb. 7, 2006

(54) FOLDING TABLE FOR WHEELCHAIR

(76) Inventor: Scott Huang, 50, Ting Pei, Hsia Pei Li, Chia Yi City (TW)

( * ) Notice: Subject to any disclaimer, the term of this patent is extended or adjusted under 35 U.S.C. 154(b) by 31 days.

(21) Appl. No.: 10/799,604

(22) Filed: Mar. 15, 2004

(65) Prior Publication Data

US 2005/0199157 A1 Sep. 15, 2005

(51) Int. Cl.
*A47B 23/00* (2006.01)

(52) U.S. Cl. ..... 108/42; 297/148

(58) Field of Classification Search ..... 108/42, 108/44; 297/148, 145, 150, 153, 154, 155, 297/160, 161, 162, DIG. 4, 174 R, 173
See application file for complete search history.

(56) References Cited

U.S. PATENT DOCUMENTS 3,338,627 A * 8/1967 Frank ..... 297/153
3,632,161 A * 1/1972 Arfaras et al. ..... 297/145
4,779,884 A * 10/1988 Minati ..... 280/304.1
4,944,552 A * 7/1990 Harris ..... 297/145
5,026,114 A * 6/1991 Miller ..... 297/145
5,799,964 A * 9/1998 Chao ..... 280/304.1
6,347,590 B1 * 2/2002 D'Annunzio et al. ..... 108/44

* cited by examiner

*Primary Examiner*—Jose V. Chen
(74) *Attorney, Agent, or Firm*—Stites & Harbison PLLC; Marvin Petry

(57) ABSTRACT

A folding table for a wheelchair includes a mounting base fixed to one of two arms of a wheelchair, a shaft, a connecting member, and a folding plate assembly. The shaft pivotally and slidably extends through a tubular member of the mounting base. The folding plate assembly includes three plates that can be folded when not in use or unfolded when in use. One of the plates is connected to the shaft by the connecting member. An overall length of the plates in the unfolded state is greater than a distance between the arms of the wheelchair.

2 Claims, 4 Drawing Sheets

FOLDING TABLE FOR WHEELCHAIR

BACKGROUND OF THE INVENTION

1. Field of the Invention

The present invention relates to a folding table for a wheelchair. In particular, the present invention relates to a folding table mounted to an arm of a wheelchair to provide convenient use.

2. Description of the Related Art

FIG. 5 of the drawings illustrates a conventional folding table for a wheelchair 1'. The folding table includes a board or plate 2' pivotally attached to each arm 11' of the wheelchair 1'. In use, the plates 2' are pivoted to a horizontal position and together form a table. Nevertheless, the distance between the table and the user cannot be adjusted. Further, as illustrated in FIG. 6, the distance from a pivotal pin A, A' of each plate 2' to an inner lower corner C, C' of the plate 2' is larger than that from the pivotal pin A, A' to the inner side B, B' of the plate 2'. In order to prevent the plates 2' from interfering with each other and thus failing to form a table, the sum of the distance from the pivotal pin A to the inner side B of one of the plates 2' and the distance from the pivotal pin A' to the inner side B' of the other plate 2' must be smaller than the sum from the pivotal pin A to the inner lower corner C of one of the plates 2' and the distance from the pivotal pin A' to the inner lower corner C' of the other plate 2'. As a result, the resultant table has a gap G between the plates 2', incurring inconvenience. Further, the inner side B, B' of each plate 2' is not supported and thus may move downward when loaded with a heavy object or the user places his or her elbow on the plate 2', which also causes inconvenience.

SUMMARY OF THE INVENTION

In accordance with an aspect of the present invention, a folding table for a wheelchair includes a mounting base fixed to one of two arms of a wheelchair, a shaft, a connecting member, and a folding plate assembly. The shaft pivotally and slidably extends through a tubular member of the mounting base. The folding plate assembly includes three plates that can be folded when not in use or unfolded when in use. One of the plates is connected to the shaft by the connecting member. An overall length of the plates in the unfolded state is greater than a distance between the arms of the wheelchair.

An end of the table formed by the plates of the folding plate assembly can be supported by the other arm of the wheelchair. The whole folding plate assembly can be moved to a desired position by sliding the shaft.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
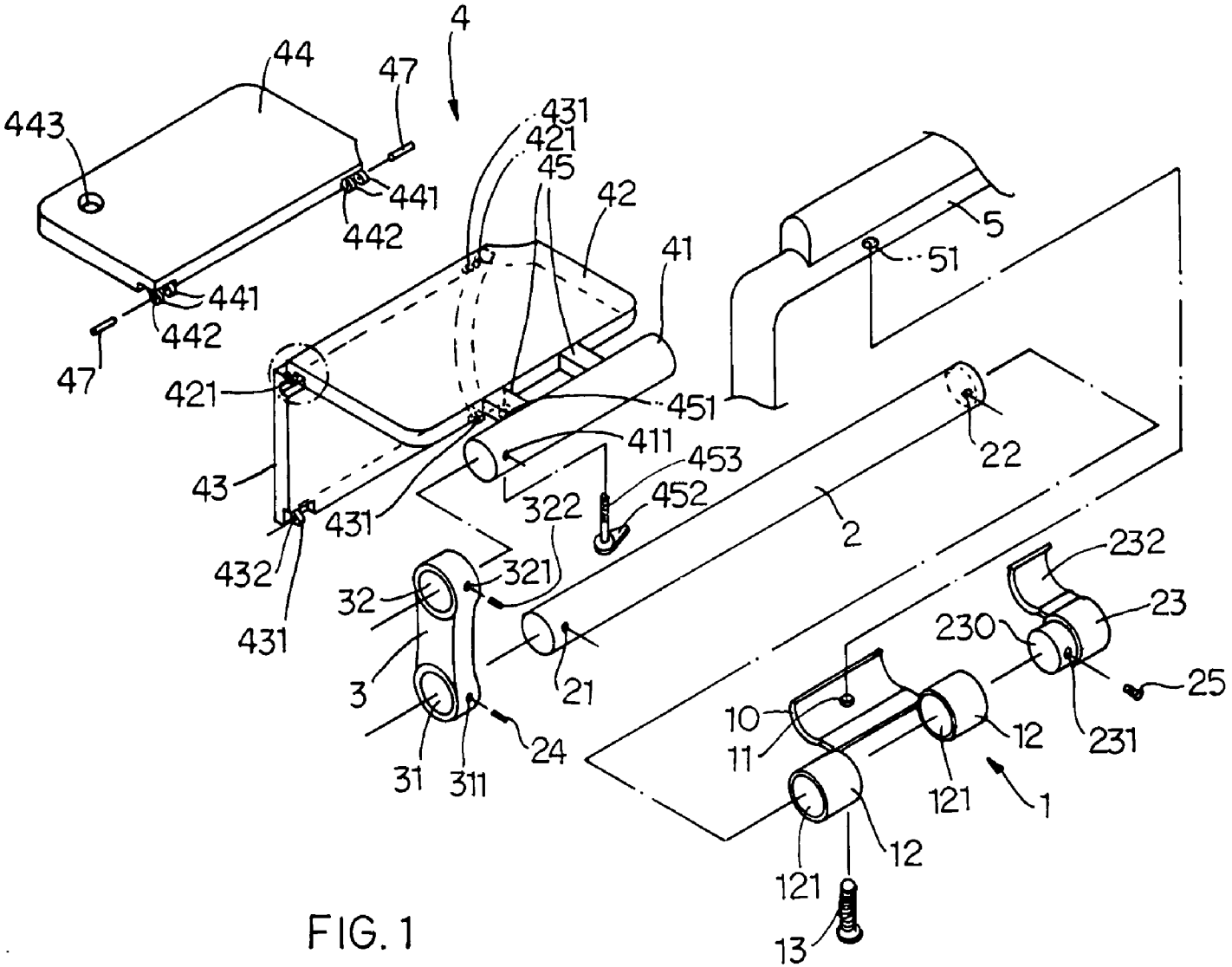
FIG. 1 is an exploded perspective view of a folding table for a wheelchair in accordance with the present invention.
Figure 2:
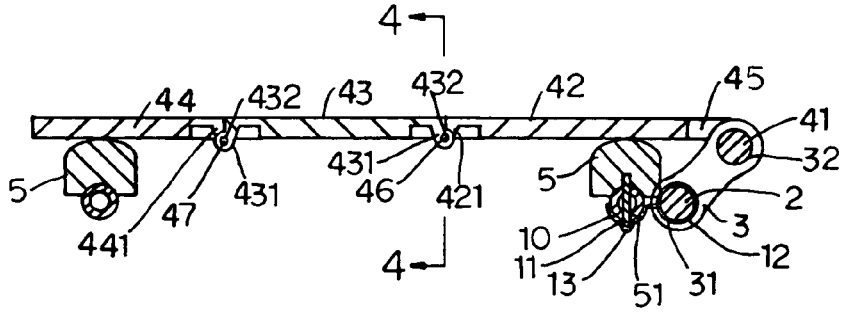
FIG. 2 is a sectional view of the folding table in accordance with the present invention.
Figure 3:
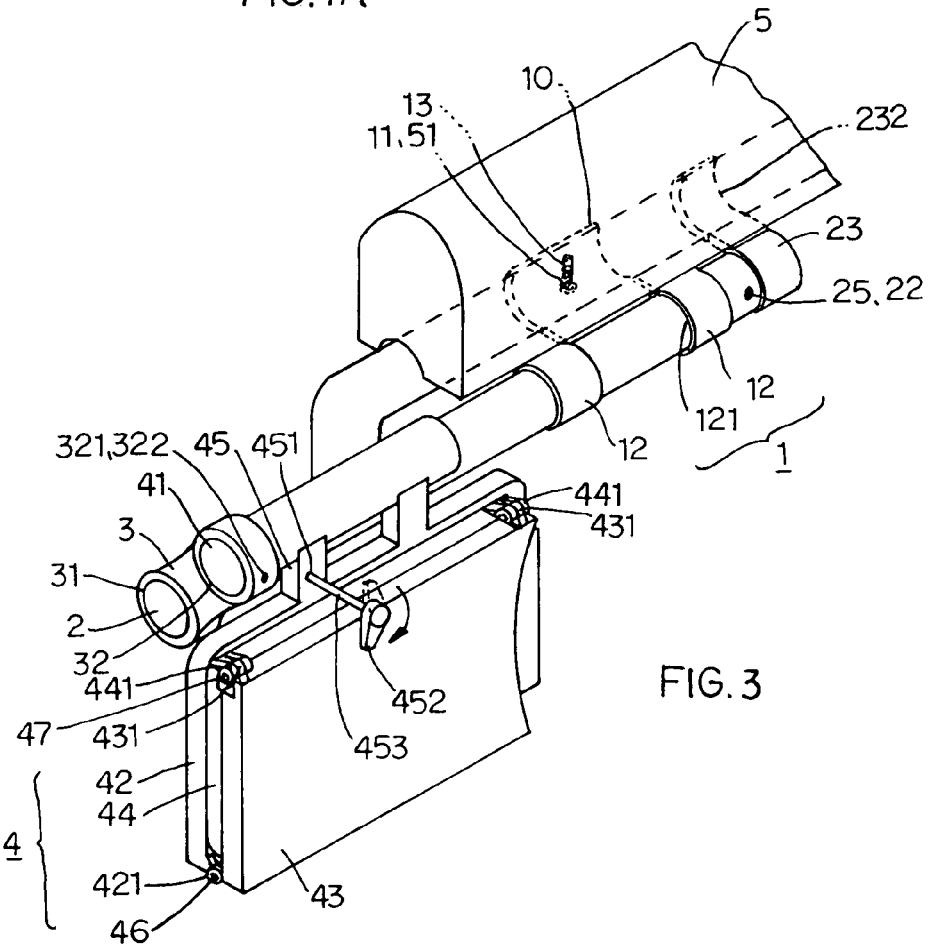
FIG. 3 is a perspective view of the folding table and an arm of a wheelchair to which the folding table is mounted.

Referring to FIGS. 1 through 3, a folding table for a wheelchair in accordance with the present invention comprises a mounting base 1, a shaft 2, a connecting member 3, and a folding plate assembly 4.

The mounting base 1 includes an attachment plate 10 having at least one hole 11. A fastener 13 is extended through the hole 11 of the attachment plate 10 into a hole 51 in an arm 5 of a wheelchair. Thus, the attachment plate 10 is fixed to the arm 5 of the wheelchair. The attachment plate 10 includes at least one tubular member 12 having a hole 121 for receiving the shaft 2. In this embodiment, the attachment plate 10 has two tubular members 12 on two ends thereof, with the shaft 2 extending through aligned holes 121 of the tubular members 12.

The connecting member 3 is fixed by welding or bonding to an end of the shaft 2, and a stop 23 is fixed by welding or bonding to the other end of the shaft 2. The stop 23 has a diameter larger than an inner diameter of the hole 121 of the tubular member 12. Alternatively, in this embodiment, a fastener 24 is extended through a radial hole 311 in a periphery delimiting a first hole 31 of the connecting member 3 and through an engaging hole 21 in the end of the shaft 2. Another fastener 25 is extended through an engaging hole 22 in the other end of the shaft 2 and through a radial hole 231 in a protrusion 230 projecting from the stop 23. Thus, the connecting member 3 and the stop 23 are respectively fixed to two ends of the shaft 2, allowing the shaft 2 to slide or rotate in the tubular members 12 without the risk of falling out of the tubular members 12. The stop 23 may further include an arcuate plate 232 extending from a side thereof. The arcuate plate 232 is in intimate contact with a bottom portion of the arm 5 to prevent the front end of the shaft 2 from declining forward.

The connecting member 3 includes the above-mentioned first hole 31 and a second hole 32. The first hole 31 has an inner diameter slightly larger than an outer diameter of the end of the shaft 2 for receiving the end of the shaft 2 that is fixed in place by the fastener 24. The second hole 32 of the connecting member 3 receives an end of a rod 41 of the folding plate assembly 4. The connecting member 3 and the end of the rod 41 can be fixed together by welding or bonding. Alternatively, in this embodiment, the second hole 32 of the connecting member 3 has an inner diameter slightly larger than an outer diameter of the end of the rod 41. A fastener 322 is extended through a radial hole 321 in a periphery delimiting the second hole 32 of the connecting member 3 and an engaging hole 411 of the rod 41.

The folding plate assembly 4, when in an extended state, has an overall length larger than a distance between two arms 5 of the wheelchair. The folding plate assembly 4 includes a first plate 42, a second plate 43, and a third plate 44. The first plate 42 includes a connecting portion 45 on a side thereof, with the connecting portion 45 being fixed with the rod 41. A pivotal block 452 includes an eccentric shaft 453 that is threadedly engaged with a screw hole 451 in a bottom of the connecting portion 45. By such an arrangement, the pivotal block 452 may pivot about the eccentric shaft 453 to a position retaining the folding plate assembly 4 in place or to another position releasing the folding plate assembly 4.

Figure 1A:
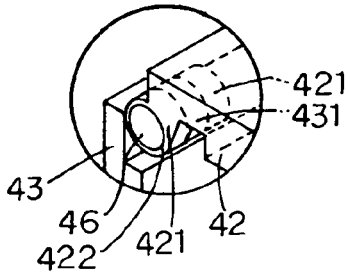
FIG. 1A is an enlarged view of a circled portion in FIG. 1.
Figure 4:
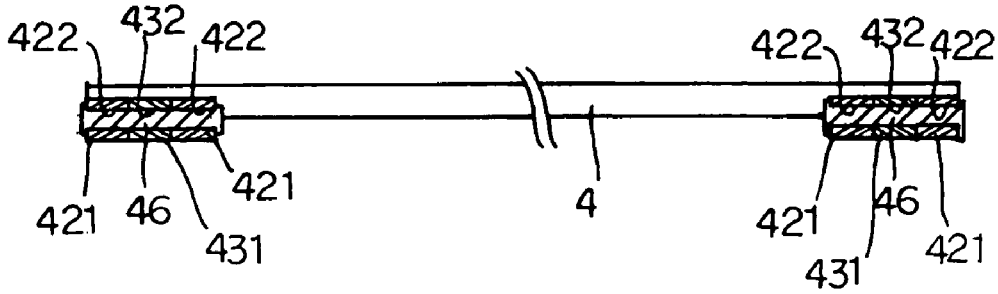
FIG. 4 is a sectional view taken along plane 4—4 in FIG. 2.
Figure 6:
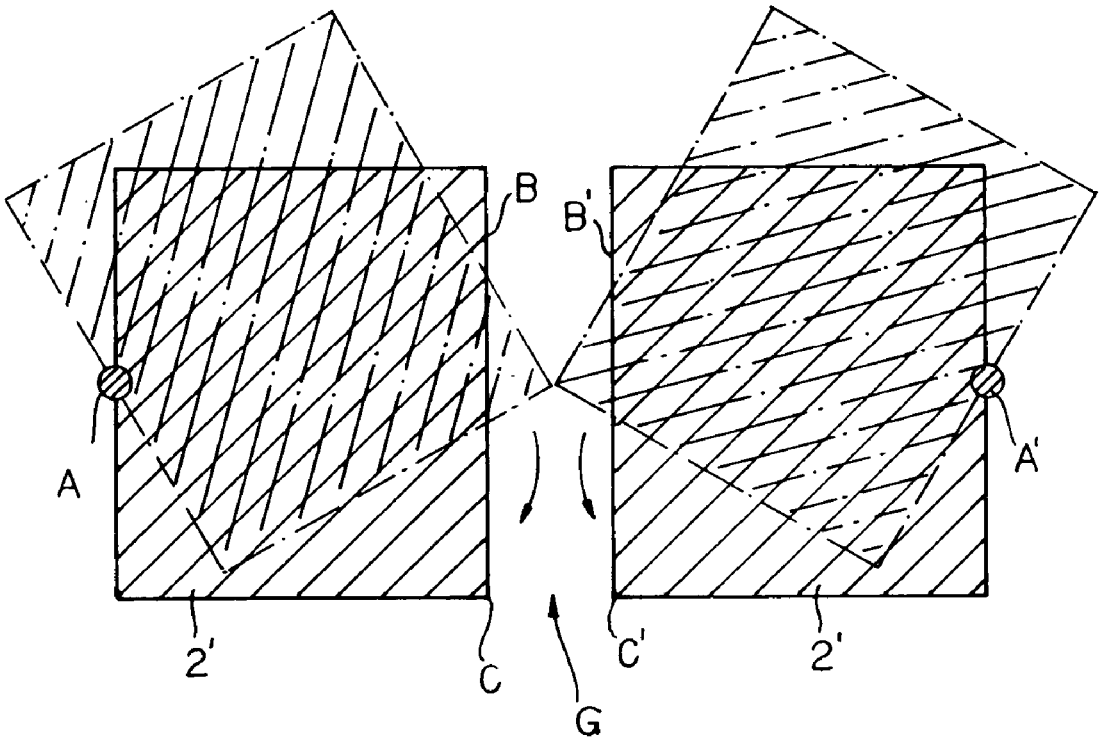
FIG. 6 PRIOR ART
FIG. 6 is a view illustrating pivotal movement of the folding table in FIG. 5.
Figure 5:
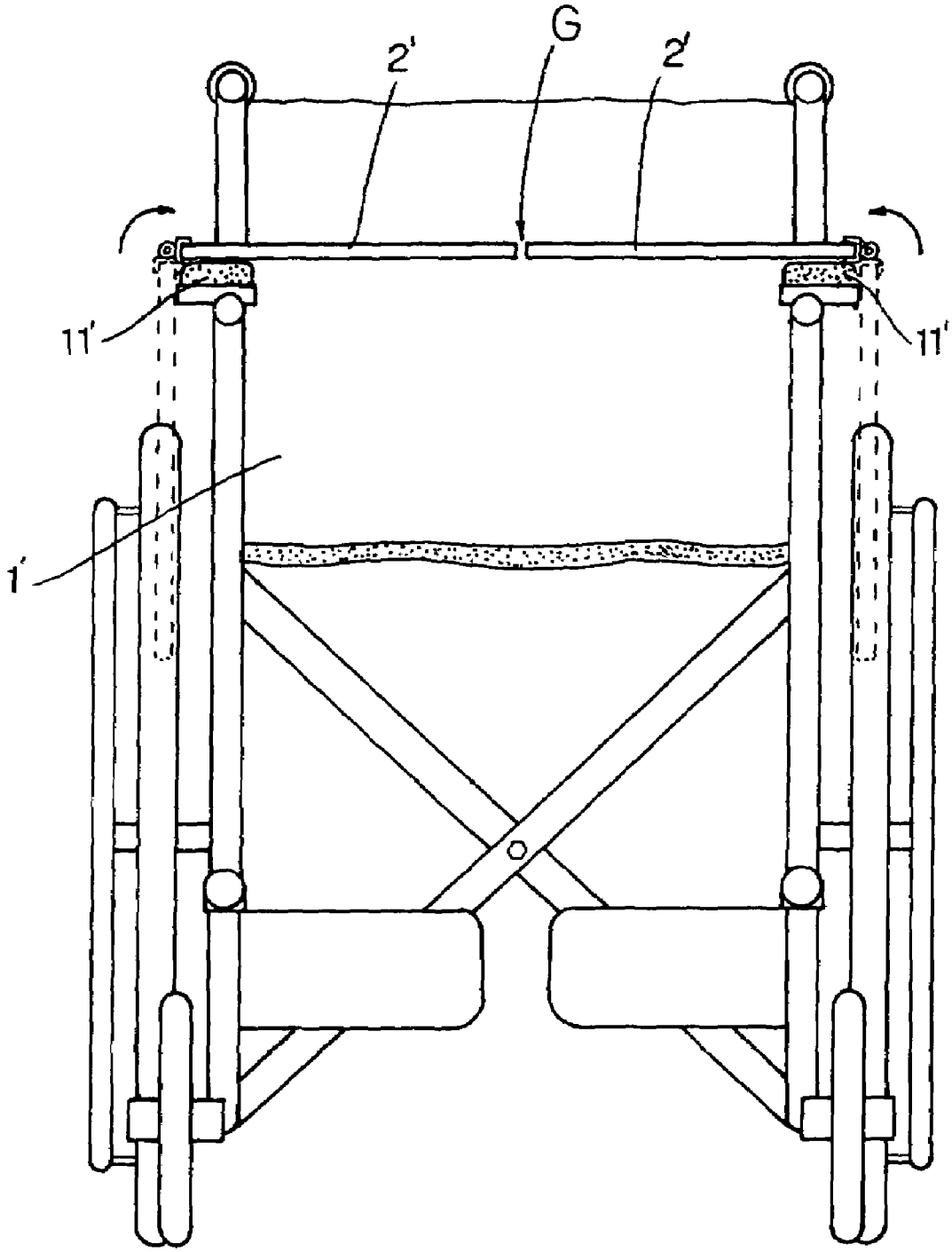
FIG. 5 PRIOR ART
FIG. 5 is a schematic view illustrating a conventional wheelchair with a folding table.

Referring to FIG. 1A and FIG. 4, a plurality of rings 421 are provided on each of two ends of the other side of the first plate 42 and have aligned holes 422. A plurality of rings 431 are provided on each of two ends of each of two sides of the second plate 43 and have aligned holes 432. When coupling a side of the second plate 43 to the other side of the first plate 42, the rings 421 are aligned with the rings 431; i.e., the holes 422 are aligned with the holes 432. A pivotal pin 46 is extended through the holes 422 and 432, allowing a side of the second plate 43 to pivot relative to the other side of the first plate 42. The first and second plates 42 and 43 can thus be folded or unfolded.

A plurality of rings 441 are formed on a side of the third plate 44 and have aligned holes 442. When coupling the side of the third plate 44 to the other side of the second plate 43, the rings 441 are aligned with the rings 431; i.e., the holes 442 are aligned with the holes 432. A pivotal pin 47 is extended through the holes 442 and 432, allowing the side of the third plate 44 to pivot relative to the other side of the second plate 44. The second and third plates 43 and 44 can thus be folded or unfolded. The folding plate assembly 4 may further include a cup holding hole 443 to releasably hold a cup.

Referring to FIG. 2, the first plate 41, the second plate 42, and the third plate 44 of the folding plate assembly 4 can be unfolded to the unfolded state, forming a flat table without any gap. Namely, the adjacent sides respectively of the first plate 42 and the second plate 43 are in contact with each other, and the adjacent sides respectively of the second plate 43 and the third plate 44 are in contact with each other. Further, since the overall length of the folding plate assembly 4 in the unfolded state is larger than the distance between the arms 5 of the wheelchair, an end of the flat table consisting of the first, second, and third plates 42, 43, and 44 (i.e., the other side of the third plate 44) may reliably lie on top of the arms 5 of the wheelchair. Since the mounting base 1 of the folding table is pivotally fixed to the arm 5 of the wheelchair and since the third plate 44 of the folding plate assembly 4 is supported by the other arm 5 of the wheelchair, none of the first plate 42, the second plate 43, and the third plate 44 would move downward even a relatively heavy object is placed on the table or the user places his or elbow(s) on the table. Further, the shaft 2 can be slid to a desired position such that the distance between the table and the user can be adjusted.

Referring to FIG. 3, when not in use, the user lifts the third plate 44, folds the third plate 44 by pivoting the third plate 44 about the pivotal pins 47, and folds the second plate 43 by pivoting the second plate 43 about the pivotal pins 46. Thus, the first plate 42, the second plate 43, and the third plate 44 can be folded to a state that occupies a relatively small space. The folded folding plate assembly 4 can be then pivoted outward through 270 degrees about the shaft 2. Thus, the folded folding plate assembly 4 can be moved to a storage position on an outer side of the arm 51 to which the mounting base 1 is mounted. The pivotal block 452 can be then pivoted to a position for retaining the folded folding plate assembly 4 in place, best shown in FIG. 3.

Although the invention has been explained in relation to its preferred embodiment, it is to be understood that many other possible modifications and variations can be made without departing from the scope of the invention as hereinafter claimed.

What is claimed is:

1. A folding table for a wheelchair, comprising:

a mounting base including at least one hole through which a fastener extends, thereby fixing the mounting base to a first arm of a wheelchair, the mounting base including at least one tube having a hole;

a shaft extending through the hole of said at least one tube, the shaft including a first end and a second end, a stop being mounted to the second end of the shaft, an arcuate plate extending from a side of the stop and adapted to be disposed in intimate contact with a bottom portion of the first arm of the wheelchair;

a connecting member including a first hole and a second hole, the first end of the shaft being received in the first hole of the connecting member; and a folding plate assembly including a rod, a first plate, a second plate, and a third plate, the rod including an end having an outer diameter slightly smaller than an inner diameter of the second hole of the connecting member, the end of the rod being mounted in the second hole of the connecting member;

the first plate including a first side with a connecting portion to which the rod is fixedly attached and a second side, a screw hole being defined in a bottom of the connecting portion, a pivotal block including an eccentric rod threadedly engaged in the screw hole, thereby allowing the pivotal block to move to between a first position for retaining the folding plate assembly in place and a second position releasing the folding plate assembly, a plurality of first rings being provided on each of two ends of the second side of the first plate and having aligned holes;

the second plate including a first side and a second side each having two ends, a plurality of second rings being provided on each said end of each of the first side and the second side of the second plate and having aligned holes, with a first pin extending through the holes of the first rings of the second side of the first plate and the holes of the second rings of the first side of the second plate, thereby pivotally connecting the first side of the second plate to the second side of the first plate;

the third plate including a first side and a second side, a plurality of third rings being provided on each of two ends of the first side of the third plate and having aligned holes, with a second pin extending through the holes of the second rings of the second side of the second plate and the holes of the third rings of the first side of the third plate, thereby pivotally connecting the first side of the third plate to the second side of the second plate, an overall length of the first plate, the second plate, and the third plate in an unfolded state being larger than a distance between the first arm and a second arm of the wheelchair.

2. The folding table for a wheelchair as claimed in claim 1, wherein the folding plate assembly includes a cup-holding hole for holding a cup.

* * * * *